US006742414B1

(12) United States Patent
Brailsford et al.

(10) Patent No.: US 6,742,414 B1
(45) Date of Patent: Jun. 1, 2004

(54) RING OPENER

(76) Inventors: Stephen Nicholas Brailsford, 34 Beaconfield Ave. Coach House, Toronto, Ontario (CA), M6J 3H9; Ivan Romero Mendez, 585 Balliol St., Toronto, Ontario (CA), M4S 1E1

( * ) Notice: Subject to any disclaimer, the term of this patent is extended or adjusted under 35 U.S.C. 154(b) by 0 days.

(21) Appl. No.: 10/307,598

(22) Filed: Dec. 2, 2002

(51) Int. Cl.[7] ..... B67B 7/16
(52) U.S. Cl. ..... 81/3.55; 81/3.4; 81/3.41
(58) Field of Search ..... 81/3.4, 3.41, 3.55; D/8

(56) References Cited

U.S. PATENT DOCUMENTS

| | | | | | |
|---|---|---|---|---|---|
| 1,519,816 | A | | 12/1924 | Ward | |
| 1,558,418 | A | | 10/1925 | Wendel | |
| 1,578,627 | A | | 3/1926 | Baumgarten | |
| 2,146,272 | A | | 2/1939 | Skoog | |
| 2,548,517 | A | * | 4/1951 | Clark | 81/3.57 |
| 4,120,216 | A | | 10/1978 | Goldberg | 81/3.46 |
| 4,466,313 | A | | 8/1984 | Gardner | 81/3.46 |
| 4,667,544 | A | | 5/1987 | Milo | 81/3.09 |
| 4,765,208 | A | * | 8/1988 | Sakosky | 81/3.55 |
| 4,825,728 | A | | 5/1989 | Mitchell | 81/3.55 |
| D303,915 | S | | 10/1989 | Knutson | D8/18 |
| 5,022,288 | A | * | 6/1991 | Taktakian | 81/3.4 |
| 5,029,495 | A | * | 7/1991 | Rosenberger | 81/3.09 |
| 5,133,233 | A | | 7/1992 | Erwin | 81/3.57 |
| D337,708 | S | | 7/1993 | Morris, Jr. | D8/34 |
| D347,152 | S | | 5/1994 | Mohawk et al. | D8/40 |
| 5,329,832 | A | * | 7/1994 | Tegethoff | 81/3.55 |
| 5,347,890 | A | | 9/1994 | Rufkahr | 81/3.55 |
| D373,941 | S | * | 9/1996 | Davis | D8/40 |
| 6,098,497 | A | | 8/2000 | Larose | 81/3.4 |
| D438,075 | S | | 2/2001 | Van Meter | D8/40 |
| D454,765 | S | | 3/2002 | Jansson | D8/40 |

* cited by examiner

*Primary Examiner*—Joseph J. Hail, III
*Assistant Examiner*—Alvin J Grant
(74) *Attorney, Agent, or Firm*—Young & Basile P.C.

(57) ABSTRACT

A ring opener for opening tab-top cans and capped containers having a lip portion for removing a container tab when engaged with the container tab, and a tooth portion for removing a container cap from the container's mouth when applied to the container cap.

12 Claims, 1 Drawing Sheet

RING OPENER

FIELD OF THE INVENTION

The present invention relates to container openers, and more particularly to a ring for opening tab-top cans and capped containers.

BACKGROUND OF THE INVENTION

Bartenders and waiters often require to open a large number of beverage containers in a fast and expeditious manner. Most beverage containers are in the form of a bottle having a removable top cap, or cans including a frangible top portion and a tab hingedly attached to the top of the can above the frangible portion, such that upon lifting the tab, the tab levers the frangible portion downwardly, thereby allowing access to the contents of the can.

A number of opening devices currently exist to assist bartenders and waiters in opening beverage containers. However, known openers have a number of problems. A primary difficulty associated with existing openers is that they can be easily lost or misplaced, for a professional bartender must intermittently place down the opener, mix or serve a drink, charge the customer, and look for the opener again in order to serve another customer.

Furthermore, known hand-held openers typically have a long handle, which may be burdensome to manipulate and carry around, as the operator must remove other items such as money held in his or her hand in order to manipulate the opener.

Various hand wearable container opening devices have been proposed in the past to address the foregoing problems. However, the proposed wearable openers are generally cumbersome to use, are not ergonomically designed, and have sharp edges which may break fingernails or cause cuts to the hand of the operator.

BRIEF SUMMARY OF THE INVENTION

The present invention provides a ring opener for opening tab-top and capped containers which addresses the shortcomings associated with known openers.

The present invention arises from the realization that existing openers are cumbersome to use and generally cannot be used to open both tab-top and capped containers in an expeditious manner. Accordingly, the present invention provides a ring opener wearable on a hands' finger, wherein the ring is configured and shaped to assist the operator in removing a bottle cap or lift-opening a container tab. Advantageously, a removable bezel including an insignia or a trademark could be attached to the ring to be used as corporate advertisement or prize. The ring can be worn on any finger by either right handed or left handed users and can be adjusted to accommodate fingers of differing thicknesses. Conveniently, the ring includes a rubber comfort linking to absorb some of the pressure exerted by a container cap or tab against the operator's finger to prevent injuries. A number of ventilation holes may also be included on the ring to prevent liquid or sweat built-up between the ring and the operator's finger.

In a first aspect, the present invention provides a ring opener comprising a ring opener for opening a tab-top container or a capped container including a ring-shaped body favorably sized for accommodating an operator's finger. The ring shaped body comprises a tab-lifting component for removing a tab-top container's tab, as well as cap-removing component for de-capping the capped container's cap. The tab-lifting compoent is substantially parallel to a center line of the operator's finger when the ring-shaped body is on the finger.

In another aspect, the present invention provides a ring opener comprising a ring for opening a tab-top container or a capped bottle. The ring comprises a body portion favorably sized for accommodating an operator's finger therein. The the body portion further defines a recess area having opposed edges for engaging a container's cap, as well as a lip extending outwardly from the body portion for engaging a container's tab.

In yet another aspect, the present invention provides a ring wearable on a finger for opening tab-top or capped containers, such that the ring includes a body having a first portion thereof forming a lip for removing a container's tab when engaged with the container's tab, and a second portion thereof forming a tooth for removing a container cap from the container's mouth when applied to the container cap.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made to the accompanying drawings, which show, by way of example, embodiments of the present invention, and in which.

DETAILED DESCRIPTION OF THE EMBODIMENT

Figure 1:
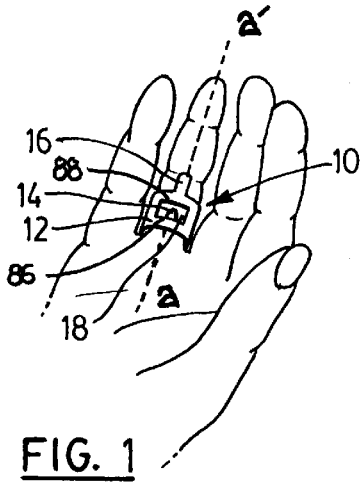
FIG. 1 is a perspective view of the ring opener worn on an operator's hand according to an embodiment of the present invention.

The present invention is now described with reference to accompanying drawings, wherein like constituent elements are designated by like reference numerals throughout the drawings.

FIG. 1 illustrates a ring opener worn on an operator's finger in accordance with an embodiment of the current invention. The ring opener 10 includes a generally ring-shaped body 12 to frictionally engage an operator's finger. The ring opener body 12 includes a lip 16 for grasping a container tab, and a generally arcuate tooth 14 for engaging a container cap. The ring opener body 12 can be made of different sizes to accommodate fingers of various sizes and can be conveniently worn in any finger of the right or left hand.

Figure 5:
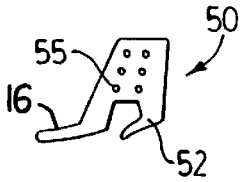
FIG. 5 is a side elevational view of another embodiment of the present invention having ventilation holes.

The lip 16 projects circumferentially from the upper edge of ring opener body 12 and is substantially parallel to the centerline a–a' of the operator's finger. Advantageously, the lip 16 terminates in a tapered portion as illustrated in FIG. 5 to ease the insertion of the lip 16 between a container tab and the container top.

The cap-engaging tooth 14 protrudes into a recess area 18 in the ring body 12 which is adapted to accommodate a container cap therein. The tooth 14 extends substantially parallel to the centerline a–a' of the operators finger and may extend in an offset plane with respect to the plane of the lip 16. As can be appreciated from FIG. 1, the tooth 14 extends from a lower edge 86 of the recess area 18, and terminates at an end that is spaced apart from an upper edge 88 of the recess area l8.

For ease of fabrication, the lip 16 and the tooth 14 are an integral part of the ring opener body 12. Advantageously, the ring body 12 is made of hard plastic or non-corrosive metals such as aluminum or stainless steel in order to prevent the ring body 12 from rusting, which may cause irritation the operator's skin. Advantageously, the ring body 12 may be magnetized in order to attract opened tabs or caps.

Figure 2:
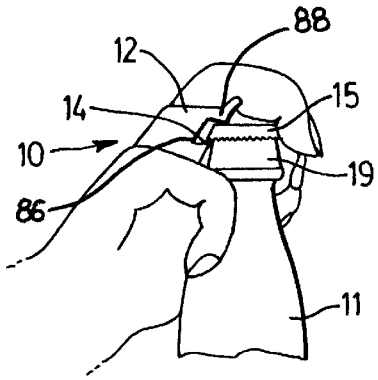
FIG. 2 is a perspective view of the ring opener in position during de-capping of a capped container according to the present invention.
Figure 3:
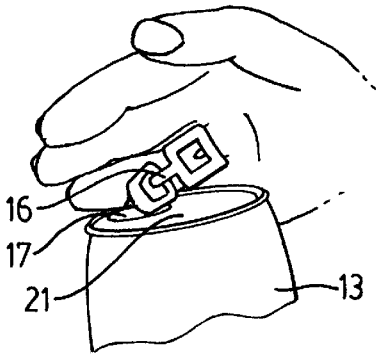
FIG. 3 is a perspective view of the ring opener in position during removal of a tab-top container's tab according to the present invention.

Reference is now made to FIGS. 2 and 3 wherein the ring opener 10 is shown in operation. The ring opener 20 is first inserted over the operator's finger, such that the lip 16 and tooth 14 face the palm of the operator. Referring to FIG. 2, when opening a capped-top container 11 having a mouth 19 sealed by a cap 15, the tooth 14 is first inserted between the cap 15 and the container mouth 19, such that the recess area 18 houses the cap and the upper edge 88 of the recess 18 engages the top of the cap 15 therein while at the same time the tooth 14 engages or "bites" the lower edge of the cap 15. The operator can then de-cap the container 11 by flexing his or her hand upwardly while at the same time exerting pressure on the cap 15, causing the ring opener 10 to first pivot about its upper edge 88 to loosen a portion of the edge of the cap 15, and then collectively pivot the opener 10 and the cap 15 against the container mouth 19 to pry off or remove the cap 15 from the mouth 19. Referring now to FIG. 3, when opening a container 13 having a tab 17, the lip 16 is gently slid under the tab 17 to position it between the tab 17 and the container top 21. Upward movement of the operator's hand causes the lower end of tab 17 to lever downwardly and pierce the frangible portion of the container top 21, thereby providing access to the container's 13 content.

Figure 4:
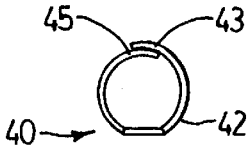
FIG. 4 is a top plan view of a size-adjustable embodiment of the present invention.

Reference is now made to FIG. 4 which illustrates another embodiment of the present invention which is similar to ring opener 10 except that the ring opener 40 includes a body 42 having overlapped end portions 43, 45, and the ring is made of a rigid but pliable material to allow variation in the effective ring opener body 42 size by varying the overlap of the end portions 43, 45 in order to accommodate fingers of varying sizes or shapes.

There is shown in FIG. 5 a further embodiment of the present invention. The ring opener 50 varies from ring opener 10 in that it includes a body 52 defining a plurality of ventilation holes 55 to prevent built-up of liquid or sweat between the ring and the operator's finger.

Figure 6:
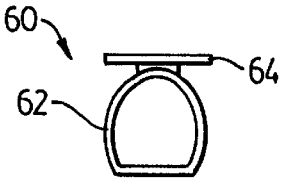
FIG. 6 a top plan view of an embodiment of the present invention having a bezel.
Figure 7:
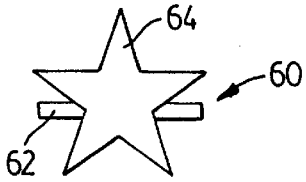
FIG. 7 is a front plan view thereof.

Referring to FIGS. 6 and 7, there is shown a ring opener 60 according to yet another embodiment of the present invention. The ring opener 60 is similar to ring opener 10, with the addition of a custom bezel 64 is attached to the ring opener body 62. The bezel 64 could be removable, or permanently affixed to the ring opener body 62 by soldering, adhesive, press-tab, or like methods as known in the art. Alternatively, the bezel 64 may form an integral part of the ring opener body 62. The bezel 62 preferably includes a insignia or a trademark to promote a product, or a decorative design in order to give the ring opener a jewelry-like appearance. Furthermore, the bezel 64 may be iridescent for enhanced visual effects.

Figure 8:
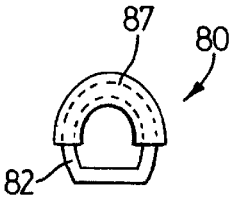
FIG. 8 is a top plan view of an embodiment of the present invention having comfort linking.

FIG. 8 illustrates an embodiment of the present invention, a ring opener 80 having a ring body 82 similar to that of the ring opener 10, however, the ring body 82 is covered by a layer of comfort linking 87 generally substantially along its length. The comfort linking 87 may be located over the part of the ring opener 80 that passes over the outside of the operator's finger. The comfort linking may be pliable, made of plastic, rubber, leather, or other similar material to absorb some of the pressure exerted on the operator's finger while opening a capped or tab-top container.

The present invention may be embodied in other specific forms without departing from the spirit or essential characteristics thereof. Certain adaptations and modifications of the invention will be obvious to those skilled in the art. For instance, the size of the ring opener may be adjusted by other ring size adjustment techniques known in the art. Moreover, the portions that form the lip 16 and tooth 14 could have shapes other than those shown in the figures. In some embodiments, the tooth 14 could be absent, with the lower edge 86 of the recess area 18 being used to engage the lower edge of a cap 15 to lever it off the bottle 11. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A ring for opening a tab-top container and a capped bottle, the ring comprising:

a body portion favorably sized for accommodating an operator's finger therein; the body portion defining:

a cap receiving area on a first side of the body portion having opposed edges for engaging a container's cap; and a lip extending outwardly from an end of the body portion on the first side for engaging a container's tab, wherein the lip is oriented to extend substantially parallel to a centerline of the operator's finger when the ring is worn on the operator's finger.

2. The ring opener as set forth in claim 1, wherein one of the opposed edges of the recess area defines a tooth extending into the cap receiving area for engaging a container's cap, the tooth being arranged to extend substantially parallel to the centerline of the operator's finger.

3. The ring opener as set forth in claim 2, wherein the tooth and the lip extend in substantially the same direction, with the tooth extending in a plane offset with respect to a plane of the lip.

4. The ring opener as set forth in claim 1, wherein the lip terminates in a tapered portion.

5. The ring opener as set forth in claim 1, wherein the ring body portion is made of non-corrosive material selected from the group consisting of aluminum, stainless steel or hard plastic.

6. The ring opener as set forth in claim 1, further comprising a comfort linking on at least a portion of the body portion to substantially absorb the pressure exerted by the body portion on the operator's finger.

7. The ring opener as set forth in claim 6, wherein the comfort linking is made of a pliable material selected from the group consisting of plastic, rubber or leather.

8. The ring opener as set forth in claim 1, wherein the body portion includes a first and second overlapped portions, and a size of the ring opener can be adjusted by changing an overlap between the first and second overlapped portions.

9. The ring opener as set forth in claim 1, wherein the body portion is magnetized.

10. A ring for opening a tab-top container and a capped bottle, the ring comprising:

a body portion favorably sized for accommodating an operator's finger therein, the body portion defining:

a cap receiving area on a first side of the body portion having opposed edges for engaging a container's cap;

a lip extending outwardly from an end of the body portion on the first side for engaging a container's tab; and an outward facing bezel secured to the body portion.

11. The ring opener as set forth in claim 10, wherein the bezel is iridescent.

12. A ring for opening a tab-top container and a capped bottle, the ring comprising:

a body portion favorably sized for accommodating an operator's finger therein, the body portion defining:

a cap receiving area on a first side of the body portion having opposed edges for engaging a container's cap;

a lip extending outwardly from an end of the body portion on the first side for engaging a container's tab; and ventilation holes to prevent liquid build-up between the operator's finger and the body portion.

* * * * *